US008594525B2

(12) United States Patent
Hirai et al.

(10) Patent No.: US 8,594,525 B2
(45) Date of Patent: Nov. 26, 2013

(54) IMAGE FORMING APPARATUS

(75) Inventors: Masahide Hirai, Numazu (JP); Tomoaki Nakai, Numazu (JP); Yasutaka Yagi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 152 days.

(21) Appl. No.: 13/304,926

(22) Filed: Nov. 28, 2011

(65) Prior Publication Data

US 2012/0148286 A1 Jun. 14, 2012

(30) Foreign Application Priority Data

Dec. 9, 2010 (JP) ..... 2010-274700

(51) Int. Cl.
*G03G 15/00* (2006.01)
*G03G 15/16* (2006.01)

(52) U.S. Cl.
USPC ..... 399/71; 399/101

(58) Field of Classification Search
USPC ..... 399/71, 101
See application file for complete search history.

(56) References Cited

U.S. PATENT DOCUMENTS 5,489,972 A * 2/1996 Shuster et al. ..... 399/313
5,621,509 A * 4/1997 Karashima et al. ..... 399/46
6,173,135 B1 1/2001 Yuminamochi et al.
6,341,205 B1 * 1/2002 Yoshino et al. ..... 399/101
7,764,900 B2 * 7/2010 Hyakutake et al. ..... 399/101
8,095,032 B2 * 1/2012 Torimaru et al. ..... 399/101
8,326,163 B2 * 12/2012 Ai ..... 399/49
2006/0067729 A1 * 3/2006 Ikeda et al. ..... 399/101
2008/0037038 A1 * 2/2008 Arai ..... 358/1.2
2008/0226313 A1 * 9/2008 Tsuchida et al. ..... 399/44
2009/0190946 A1 7/2009 Ai
2009/0304403 A1 * 12/2009 Inada ..... 399/44
2009/0317099 A1 * 12/2009 Masumoto et al. ..... 399/31
2010/0008696 A1 * 1/2010 Furuya et al. ..... 399/101
2010/0284704 A1 11/2010 Nakayama

FOREIGN PATENT DOCUMENTS

JP 2000-29281 A 1/2000
JP 2009-180865 A 8/2009
JP 2010-72327 A 4/2010
JP 2010-72396 A 4/2010

* cited by examiner

*Primary Examiner* — Walter L Lindsay, Jr.
*Assistant Examiner* — David Bolduc
(74) *Attorney, Agent, or Firm* — Fitzpatrick, Cella, Harper & Scinto

(57) ABSTRACT

In an image forming apparatus, a control unit is capable of carrying out a cleaning mode with a first step of allowing an image forming unit to form, on an image bearing member, a cleaning toner image with a length according to a length of a feeding member or conveying member in a direction orthogonal to a conveyance direction of the recording material, a second step of moving the cleaning toner image from the image bearing member to a transfer member, and a third step of moving the cleaning toner image from the transfer member to the image bearing member.

16 Claims, 6 Drawing Sheets

IMAGE FORMING APPARATUS

BACKGROUND OF THE INVENTION

1. Field of the Invention

The present invention relates to an image forming apparatus, such as a copier, a laser printer, or a facsimile machine based on an electrophotographic scheme.

2. Description of the Related Art

In a conventional electrophotographic image forming apparatus, the surface of a photosensitive drum is charged and exposed to light by an exposure unit to form an electrostatic latent image. Then, the electrostatic latent image is developed into a toner image by a developing unit using toner. The toner image is then primarily transferred to an intermediate transfer belt. To form a color image, the above-described steps are repeated to form a color toner image on the intermediate transfer belt. The formed color toner image is secondarily transferred to a recoding material. Thereafter, the color toner image on the recording material is fixed by a fixing unit.

In connection with the secondary transfer of a color toner image to a recording material, a configuration has been known in which a transfer bias is applied to a transfer roller that contacts and conveys the recording material.

Toner may adhere to the transfer roller. Japanese Patent Application Laid-Open No. 2000-029281 discloses cleaning of the adhering toner by means of application of a cleaning transfer bias to the toner.

The transfer roller serves to contact and convey a recording material. Thus, in many cases, paper dust adheres to the transfer roller. The paper dust adhering to the transfer roller is often charged owing to the effect of a transfer bias or sliding friction against the roller.

In recent years, there have been demands to increase the operating speeds and lives of image forming apparatuses. Furthermore, with distribution of a variety of recording materials, image forming apparatuses have been desired to demonstrate an improved transfer capability and enhanced durability with respect to any recording materials. In the conventional art, when, in particular, a large amount of recycled paper or vile paper, a large number of recording materials containing a large amount of loading material such as talc, or a large amount of paper involving a large amount of paper dust passes through the image forming apparatus, a large amount of paper dust may adhere to the transfer roller. As a result, the transfer capability may be degraded.

SUMMARY OF THE INVENTION

The present invention has been developed in view of the above-described circumstances. An object of the present invention is to efficiently clean a transfer member to prevent possible transfer failures, thus obtaining appropriate images.

Another object of the present invention is to provide an image forming apparatus, including an image bearing member that bears a toner image, an image forming unit that forms a toner image on the image bearing member, a control unit, a transfer member that forms a transfer portion with the image bearing member and transfers the toner image from the image bearing member to a recording material conveyed to the transfer portion, a feeding member that feeds the recording material to the transfer portion and a conveying member that conveys the recording material fed by the feeding member, wherein the control unit is capable of performing a cleaning mode including a first step in which the image forming unit forms, on the image bearing member, a toner image for cleaning (hereinafter referred to as "cleaning toner image") with a length according to a length of the feeding member in a direction perpendicular to a conveyance direction in which a recording material is conveyed, a second step of moving the cleaning toner image from the image bearing member to the transfer member, and a third step of moving the cleaning toner image from the transfer member to the image bearing member.

A further object of the present invention is to provide an image forming apparatus, including an image bearing member that bears a toner image, an image forming unit that forms a toner image on the image bearing member, a control unit, a transfer member that forms a transfer portion with the image bearing member and transfers the toner image from the image bearing member to a recording material conveyed to the transfer portion, a feeding member that feeds the recording material to the transfer portion and a conveying member that conveys the recording material fed by the feeding member, wherein the control unit is capable of carrying out a cleaning mode including a first step in which the image forming unit forms, on the image bearing member, a cleaning toner image with a length according to a length of the feeding member in a direction perpendicular to a direction in which a recording material is conveyed, a second step of moving the cleaning toner image from the image bearing member to the transfer member, and a third step of moving the cleaning toner image from the transfer member to the image bearing member.

A still further object of the present invention will be obvious with reference to the following detailed description and the attached drawings.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings. The sizes, materials, shapes, and relative arrangement of components described in the embodiments are to be appropriately changed according to the configuration of and various conditions for an apparatus to which the present invention is applied and are not intended to limit the scope of the present invention to the embodiments described below.

Exemplary Embodiment 1

Figure 1:
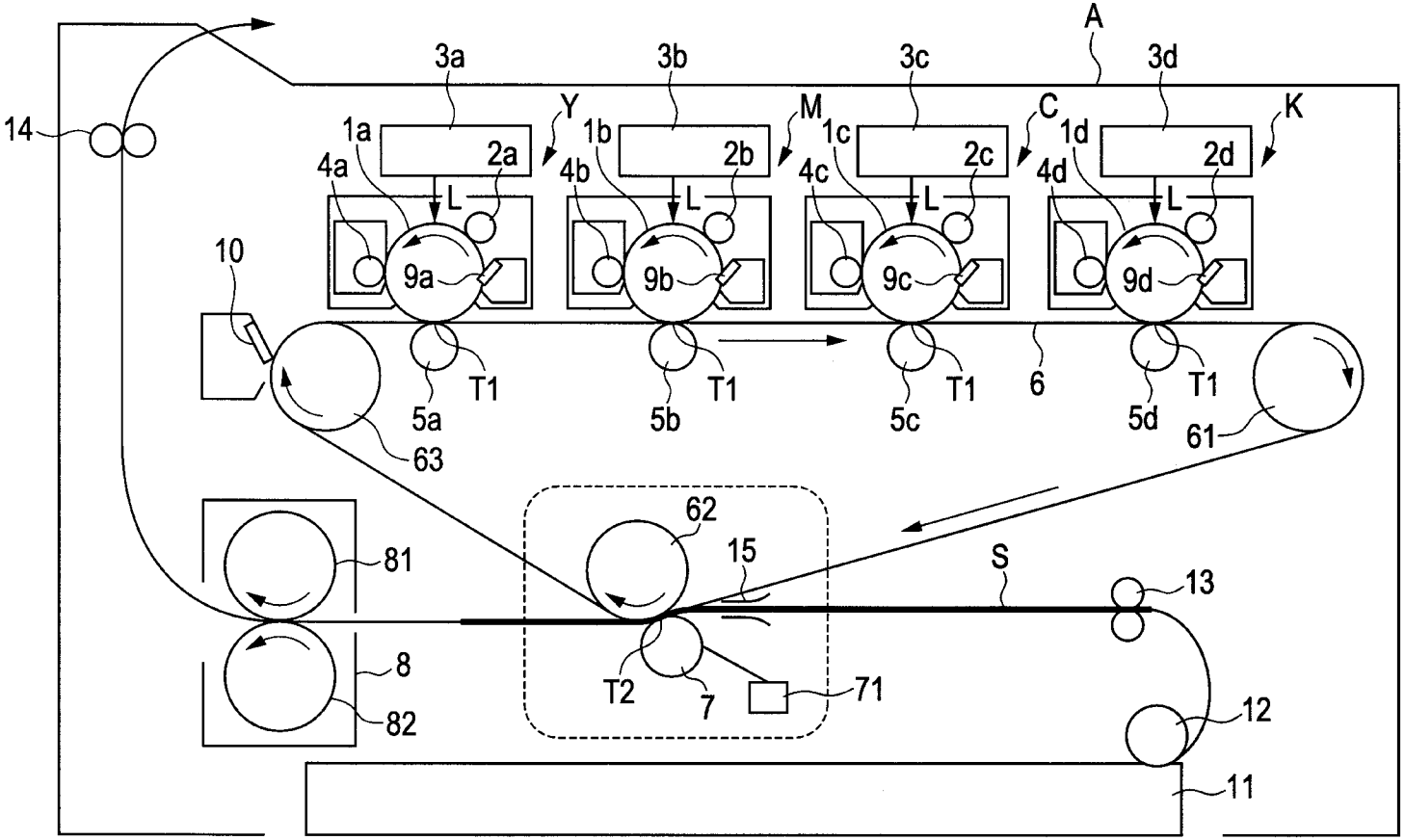
FIG. 1 is a cross-sectional view illustrating a general configuration of an image forming apparatus according to Exemplary Embodiment 1.

FIG. 1 is a cross-sectional view schematically illustrating a general configuration of a tandem color image forming apparatus serving as an image forming apparatus according to the present exemplary embodiment.

<Image Forming Operation of the Image Forming Apparatus>

First, an image forming operation of an image forming apparatus A according to the present exemplary embodiment will be described.

The surface of a photosensitive drum 1 (1*a*, 1*b*, 1*c*, 1*d*) rotating at a predetermined speed is changed to a predetermined potential by a roller-like charging member 2 (2*a*, 2*b*, 2*c*, 2*d*). The photosensitive drum 1 (1*a*, 1*b*, 1*c*, 1*d*) charged to the predetermined potential is irradiated with irradiation light L by an exposure unit 3 (3*a*, 3*b*, 3*c*, 3*d*) according to an image pattern to form an electrostatic latent image on the surface of the photosensitive drum 1. A developing unit 4 (4*a*, 4*b*, 4*c*, 4*d*) configured to visualize the electrostatic latent image formed on the photosensitive drum 1 forms toner images on the photosensitive drum 1.

The color toner images formed on the photosensitive drum 1 are transferred onto an intermediate transfer belt (intermediate transfer member) 6 serving as an image bearing member, by a primary transfer roller 5 (5*a*, 5*b*, 5*c*, 5*d*) with timing controlled such that the color toner images overlap (primary transfer). At this time, the primary transfer is carried out by applying a predetermined transfer bias to the primary transfer roller 5. Here, the photosensitive drum 1, the exposure unit 3, and the developing unit 4 form an image forming unit. In the present exemplary embodiment, a plurality of image forming units is provided along a rotation (movement) direction of the intermediate transfer belt 6. The primary transfer roller is provided opposite each of the image forming units.

The color image formed on the intermediate transfer belt 6 (image bearing member) is transferred to a recording material S fed to the intermediate transfer belt 6 at a predetermined timing, at a secondary transfer nip portion T2 by a secondary transfer roller 7 serving as a transfer member (secondary transfer). At this time, the secondary transfer is carried out by applying a predetermined transfer bias (transfer voltage) to the secondary transfer roller 7. Here, the transfer biases applied during the primary and secondary transfers have a polarity reverse to that of the toner in order to electrostatically transfer the toner image. In the present exemplary embodiment and exemplary embodiments described below, the toner used is charged to negative polarity. Here, the secondary transfer nip portion T2 corresponds to a nip portion formed between the intermediate transfer belt 6 and the secondary transfer roller 7.

The toner image in yellow, magenta, cyan, and black formed on the recording material is fixed to the recording material S by a fixation apparatus 8 configured to carry out a heating and pressing step, and then discharged to the outside of the image forming apparatus as a color image. A part of the toner remaining on the photosensitive drum 1 from the primary transfer is collected by a cleaning apparatus 9 (9*a*, 9*b*, 9*c*, 9*d*) for the photosensitive drum 1. The image forming apparatus then stands by for the next image formation. Similarly, a part of the toner remaining on the intermediate transfer belt 6 from the secondary transfer is collected by a cleaning apparatus 10 serving as a cleaning unit for the intermediate transfer belt 6. The image forming apparatus then stands by for the next image formation.

<General Configuration of the Image Forming Apparatus>

Now, the configuration of each section will be described in detail.

The photosensitive drum 1 includes, for example, an aluminum cylinder of diameter 30 mm with an organic photoconductive layer (OPC photosensitive member) coated on the outer peripheral surface thereof. The photosensitive drum 1 is rotatably supported at the opposite ends thereof by a support member. A driving force transmitted to one end of the photosensitive drum 1 by a driving motor (not shown in the drawings) allows the photosensitive drum 1 to rotate counterclockwise as shown in FIG. 1.

The charging member 2 is a conductive roller formed like a roller. When the roller comes into abutting contact with the surface of the photosensitive drum 1 and is subjected to a charging transfer bias of negative polarity by a power source (not shown in the drawings), the surface of the photosensitive drum 1 is uniformly charged.

The exposure unit 3 is a laser optical unit. When the exposure unit 3 is controlled by a driving circuit not shown in the drawings so as to expose the charged surface of the photosensitive drum 1 to irradiation light (laser light) L according to an image signal, an electrostatic latent image is formed on the photosensitive drum 1.

The developing units 4*a*, 4*b*, 4*c*, and 4*d* are each formed of a development device in which toner charged to negative polarity is housed, and are arranged such that the toner colors of the toners therein lie in the sequence of yellow (Y), magenta (M), cyan (C), and black (K) from the upstream side (left side of FIG. 1) in the rotation direction of the intermediate transfer belt 6.

When the electrostatic latent image on the photosensitive drum 1 is developed, a developing bias is applied to between a develop roller forming the development apparatus 4 and the photosensitive drum 1 with the electrostatic latent image formed thereon, and thereby the toner adheres to the electrostatic latent image to develop a toner image.

The primary transfer roller 5 is a conductive roller formed like a roller. The primary transfer roller 5, for example, includes a shaft formed of metal such as SUS (stainless steel) and having an outer diameter of 6 mm and a foamable elastic roller installed around the shaft so that the entire outer diameter of the primary transfer roller 5 is 12 mm. The foamable elastic roller offers a resistance of $10^6$ Ω to $10^9$ Ω. The primary transfer roller 5 is pressed against the photosensitive drum 1 across the intermediate transfer belt 6. The primary transfer roller 5 is then subjected to a primary transfer bias of positive polarity by a power source not shown in the drawings to transfer the toner image on the photosensitive drum 1 onto the intermediate transfer belt 6 at the primary transfer nip portion T1.

The primary transfer nip portion T1 is formed between the primary transfer roller 5 and the photosensitive drum 1 across the intermediate transfer belt 6.

The intermediate transfer belt 6 is formed of an endless film-like member (belt member) with a volume (specific) resistivity of $10^7$ to $10^{14}$ Ω cm and a thickness of about 50 to 100 μm. The volume resistivity has been obtained by using a measurement probe in conformity with JIS K6911 and a high resistance meter R8340 manufactured by ADVANTEST CORPORATION and applying a voltage of 50 to 100 V to the intermediate transfer belt 6 at a temperature of 25° C. and a relative humidity of 50%.

A driving roller 61 and driven rollers 62 and 63 are provided on an inner peripheral side of the intermediate transfer belt 6; the driving roller 61 is configured to rotate the intermediate transfer belt 6, and the driven rollers 62 and 63 are configured to apply an appropriate tension to allow the intermediate transfer belt 6 to carry out stable conveyance. The driven roller 62 also functions as a member located opposite the secondary transfer roller 7. The driven roller 63 also functions as a member located opposite the cleaning apparatus 10.

The secondary transfer roller 7 has a configuration and physical properties similar to those of the primary transfer roller 5. In this case, the secondary transfer roller 7 used has an outer diameter of 16 mm. The secondary transfer roller 7 will be described below in detail. The secondary transfer roller 7 is pressed against the intermediate transfer belt 6 across the recording material S. The secondary transfer roller 7 is subjected to a secondary transfer bias of positive polarity by a power source 71 serving as a voltage applying unit. Thus, the toner image on the intermediate transfer belt 6 is transferred onto the recording medium S.

Furthermore, the transfer guide 15 is provided to guide the recording material S to the secondary transfer nip portion T2 formed by the secondary transfer roller 7 and the intermediate transfer belt 6 supported by the driven roller 62. The recording member S is guided and conveyed to the secondary transfer nip portion T2 by the transfer guide 15.

The cleaning apparatus 9 includes a plate-like member formed of, for example, rubber, which is in abutting contact with the surface of the photosensitive drum 1. The cleaning apparatus 9 is configured to remove what is called primary transfer remaining toner remaining on the surface of the photosensitive drum 1 instead of being transferred after the toner developed on the photosensitive drum 1 by the development apparatus 4 is primarily transferred to the intermediate transfer belt 6.

Like the cleaning apparatus 9, the cleaning apparatus 10 includes a plate-like member formed of, for example, rubber, which is in abutting contact with the intermediate transfer belt 6 so as to lie opposite the driven roller 63.

The cleaning apparatus 10 is configured to remove what is called secondary transfer remaining toner remaining on the surface of the intermediate transfer belt 6 instead of being transferred after the toner on the intermediate transfer belt 6 is secondarily transferred to the recording material S by the secondary transfer roller 7.

In the image forming apparatus A formed of such members as described above, an image forming operation is performed as follows. First, a recording material S is separated from the other recording materials housed in the cassette 11 installed in the lower portion of the apparatus main body and is then fed by a feeding roller 12 serving as a feeding member.

Thereafter, the recording material S is conveyed to the secondary transfer nip portion T2 by a conveying roller pair 13 serving as a conveying member. Thus, the toner image in yellow, magenta, cyan and black formed on the intermediate transfer belt 6 is secondarily transferred to the recording material S to form a color image on the recording material S.

Then, the recording material S enters the fixation apparatus 8. The recording material S passes through a fixation nip portion formed by a heating roller 81 and a pressure roller 82 and is thus heated and pressed. Thus, the toner image is fixed on the recording material S to form a full color image. Thereafter, the recording material S with the full color image formed thereon is discharged to the upper part of the image forming apparatus by a discharge roller pair 14. As a result, a series of image forming operations (steps) end.

The characteristics of the present embodiment will be described below in detail.

First, a cleaning mode will be described in which the secondary transfer roller 7 is cleaned by application of a cleaning bias.

As described above, in the basic operation of the secondary transfer portion, the secondary transfer roller 7 is pressed against the intermediate transfer belt 6 across the recoding material S. A secondary transfer bias of positive polarity is then applied to the secondary transfer roller 7 by the power source 71. Thus, the toner image on the intermediate transfer belt 6 is transferred onto the recording material S. Here, if, for example, the recording material is jammed during conveyance or the image forming apparatus comes to a quick stop during printing, the toner may adhere to the secondary transfer roller 7. Then, when image formation is continued without taking any corrective action, the back surface of the recording material S may be stained.

Thus, a control unit provided in the image forming apparatus can carry out the cleaning mode described below in order to deal with contamination of the secondary transfer roller 7. The cleaning mode corresponds to an operation in which the power source 71 applies, to the secondary transfer roller 7, a cleaning bias that allows the toner to be transferred (moved) to the intermediate transfer belt 6 again, to move the toner adhering onto the secondary transfer roller 7 to the intermediate transfer belt 6 so that the toner can be collected by the cleaning apparatus 10.

The cleaning bias provided by the power source 71 to transfer the toner to the intermediate transfer belt 6 again has the negative polarity as a main polarity like the toner. Furthermore, to allow the toner to be efficiently cleaned, the negative and positive polarities may be alternately applied a number of times. The toner may have the regular charging polarity thereof (negative polarity) inverted and thus have the positive polarity. Thus, a cleaning bias of positive polarity can be efficiently applied to the secondary transfer roller 7.

In the present embodiment, the cleaning mode is carried out using a configuration in which transfer biases of negative and positive polarities are alternately applied to the secondary transfer roller 7 so that the transfer bias is switched every time the secondary transfer roller 7 makes one rotation and so that each transfer bias is applied for a total of three rotations of the secondary transfer roller 7. The cleaning mode may be carried out at any timing. However, in the present embodiment, the cleaning mode is carried out upon power-on, upon start-up following a jam, and every predetermined number of recording materials to constantly clean the secondary transfer roller 7. This prevents the recording material from being stained with the toner and maintains the image forming apparatus in the proper condition.

<Improper Secondary Transfer Caused by Paper Dust Contamination>

In recent years, there have been concerns about disadvantageous improper secondary transfer caused by paper dust contamination in connection with the increased lives and operating speeds of image forming apparatuses and diversified media and which is not an acknowledged problem in the conventional art.

Normally, adhering paper dust can be cleaned by carrying out the cleaning mode to apply a cleaning bias to the secondary transfer roller, provided that the amount of the paper dust is small. A paper dust which can be cleaned is a charged one. The above-described cleaning bias enables even the paper dust having adhered to the secondary transfer roller to be cleaned.

However, for example, the adhesion of paper dust to the secondary transfer roller poses problems in the following terms.

(1) The number of recording materials passing through the image forming apparatus increases consistently with the life of the apparatus. Thus, more paper dust adheres to and accumulates on the transfer roller than in the conventional art.

(2) Diversified media may contribute to increasing the amount of adhering paper dust if, for example, a large amount of recycled paper or a large number of recording materials containing a large amount of loading material such as calcium carbonate pass though the image forming apparatus.

(3) With the increased operating speed of image forming apparatuses, the sliding friction between one of the feeding member and the conveying member and the recording material has been increased to improve the capability of feeding or conveying the recording material. This results in the likelihood of paper dust adhesion.

As described above, more paper dust may occur and thus adhere to the secondary transfer roller than in the conventional art. In such a case, the above-described cleaning mode may fail to achieve sufficient paper dust cleaning, and paper dust may accumulate on the transfer roller.

If a large amount of such paper dust adheres to the transfer roller, then in a part of the transfer roller to which paper dust has adhered, the transfer capability is affected, leading to improper transfers. Such dust cannot be sufficiently cleaned by the above-described normal cleaning operation and thus has accumulated little by little over time (as a result of long use).

As described above, particularly in (3), paper dust is likely to occur in the area in which the recording material slides on one of the feeding member and the conveying member with a friction, and tends to accumulate on a part of the transfer roller which contacts this sliding friction area. For example, the following has been confirmed. If one of a large amount of recycled paper and a large amount of paper containing a large amount of loading material or calcium carbonate passes through the image forming apparatus, particularly a longitudinal part of the transfer roller which corresponds to the feeding roller may be contaminated with paper dust (the longitudinal direction corresponds to the direction of rotating shaft of the roller and is perpendicular to the conveyance direction of the recording material).

Thus, the present exemplary embodiment is characterized in that such a cleaning mode as described below is carried out to clean paper dust from the secondary transfer roller. The cleaning mode is carried out to allow the image forming unit to form cleaning assist toner on the intermediate transfer belt 6 and then to move the formed cleaning assist toner image directly to the secondary transfer roller 7. Thereafter, a cleaning bias is applied to the secondary transfer roller 7 to move the cleaning assist toner image from the secondary transfer roller 7 back to the intermediate transfer belt 6. The movement of the cleaning assist toner enables paper dust to be moved from the secondary transfer roller 7 onto the intermediate transfer belt 6, allowing the secondary transfer roller 7 to be efficiently cleaned. Thereafter, a cleaning bias is applied to the secondary transfer roller 7 to clean toner adhering to the secondary transfer roller 7 (portion of the cleaning assist toner which remains on the secondary transfer roller 7 instead of being moved to the intermediate transfer belt 6) from the secondary transfer roller 7. Such a cleaning mode as involves the formation of cleaning assist toner is referred to as a paper dust cleaning mode.

Figure 2A:
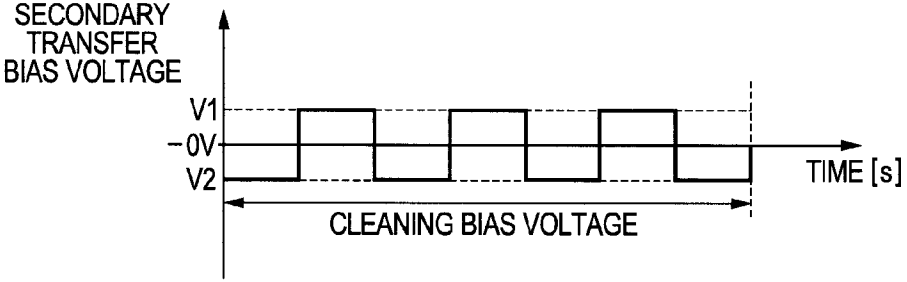
FIGS. 2A and 2B are diagrams illustrating a sequence of transfer bias application during cleaning.
Figure 2B:
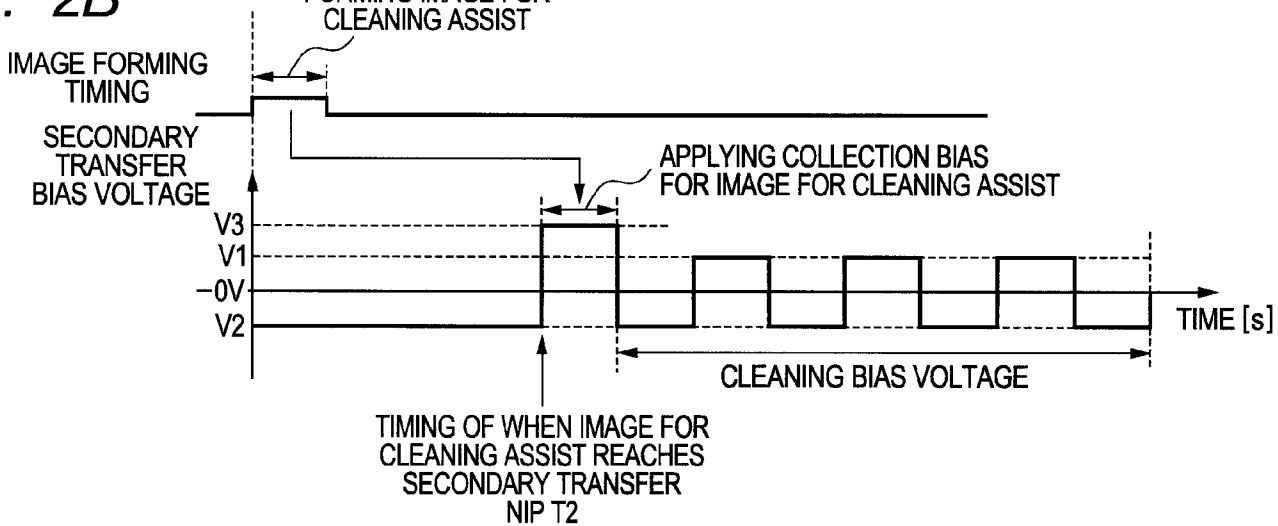

FIGS. 2A and 2B illustrate a sequence of biases applied to the secondary transfer roller under the control of the control unit while the paper cleaning mode is being carried out. FIG. 2A illustrates a sequence used when a normal cleaning mode is carried out (no cleaning assist toner is formed). FIG. 2B illustrates a sequence of cleaning mode carried out when cleaning assist toner is formed.

In the normal cleaning mode in FIG. 2A, a cleaning bias of negative polarity, which serves to prevent possible adhesion of toner, is applied to the secondary transfer roller 7 while the transfer roller is making one rotation. This allows adhering substances of negative polarity to be moved from the secondary transfer roller to the intermediate transfer belt 6. Thereafter, to allow cleaning of toner with the charging polarity reversed, what is called reverse toner, a cleaning bias of positive polarity is similarly applied to the transfer roller while the transfer roller is making one rotation. A plurality of alternate applications of such transfer biases are carried out to remove the adhering substances from the secondary transfer roller 7.

The cleaning bias may be set to any value based on the resistance values and use environments of the secondary transfer roller and the intermediate transfer belt In the exemplary embodiment, in an environment at 23° C. and 50%, a bias V1 of about +1 kV and a bias V2 of about −1 kV are alternately used.

However, even the application of such a cleaning bias may fail to sufficiently clean paper dust with one of a small charging amount and no polarity.

Now, a method for removing adhering substances (paper dust) with one of a small charging amount and no polarity from the secondary transfer roller 7 will be described with reference to FIG. 2B.

First, when the paper dust cleaning mode is started, a cleaning assist toner, which serves to efficiently collect paper dust, is formed on the intermediate transfer belt 6 by an image forming step (toner image forming operation) including the above-described charging, exposure, development, and transfer (first step).

At a timing when the tip of the cleaning assist toner reaches the secondary transfer nip portion T2, the secondary transfer roller 7 is subjected to a collecting bias allowing the toner image to be collected on the secondary transfer roller 7, in this case, a collecting bias V3 of positive polarity. Thus, the toner image is held on the secondary transfer roller 7 (second step).

The collecting bias V3 applied to collect the toner image on the secondary transfer roller 7 may be set to any value based on the resistance values and use environments of the secondary transfer roller 7 and the intermediate transfer belt 6. The collecting bias V3 used in the exemplary embodiment is about +1.5 kV in an environment at 23° C. and 50%.

Then, cleaning biases are alternately applied to the secondary transfer roller 7 as in the case of FIG. 2A to move the toner image collected on the secondary transfer roller 7 to the intermediate transfer belt 6 together with paper dust. Thus, the collection of paper dust ends (third step).

In such a configuration, when temporarily transferred to the secondary transfer roller 7, the cleaning assist toner is transferred on the paper dust adhering to and accumulated on the secondary transfer roller 7.

Thus, when the cleaning assist toner is moved to the secondary transfer roller 7 by the collecting bias, the paper dust and the toner come into contact with each other and slide on each other with a friction at the secondary transfer nip portion T2.

Hence, even paper dust with one of a small charging amount and no polarity comes into contact with and slides on the toner with a friction to cause frictional charging. As a result, the toner and the paper dust electrostatically adsorb each other and also adhere to each other owing to physical adhesion. Consequently, when the cleaning assist toner is moved by the cleaning bias, the paper dust and toner adsorbing each other move together easily, allowing the paper dust to be removed from the secondary transfer roller 7.

Now, the condition of the secondary transfer roller 7 will be described in a supplementary manner.

In the present exemplary embodiment, the secondary transfer roller 7 is a foamable elastic roller. The foamable elastic roller has a foamed cell diameter of about 50 to 200 μm and a hardness of 30° to 40° in Asker C hardness.

If such a foamable elastic roller is used, when a large amount of paper dust occurs, the paper dust may enter recessed portions of the surface of the roller and cells of the roller. In this case, adhering paper dust may be prevented from being easily collected simply by application of the cleaning bias. However, in the paper dust cleaning mode according to the present exemplary embodiment, the cleaning assist toner is transferred to the secondary transfer roller 7 before the application of the cleaning bias. This enables the toner to come into contact with and adhere to paper dust that cannot be cleaned by the conventional cleaning scheme. Thus, such paper dust can be cleaned together with the toner.

As described above, the foamable elastic roller used as the transfer roller according to the present exemplary embodiment is particularly effective for cleaning of paper dust adhering to the surface or recessed portions of the roller and which cannot be cleaned by the conventional art. However, the transfer member is not limited to the foamable elastic roller. For example, similar use of the cleaning mode according to the present exemplary embodiment allows one of a solid transfer roller, a tube transfer roller with a tube formed on the surface thereof, a coat roller with a coat layer, and a transfer belt to produce a sufficient effect of paper dust removal.

Figure 3A:
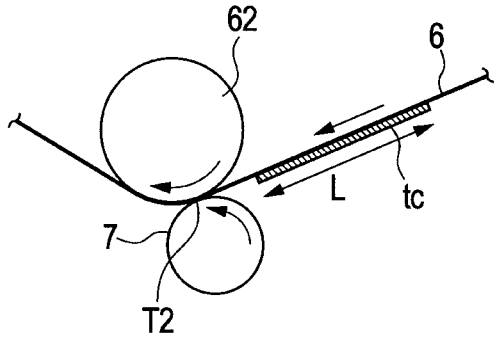
FIGS. 3A, 3B and 3C are diagrams schematically showing the condition of the image forming apparatus during cleaning.
Figure 3B:
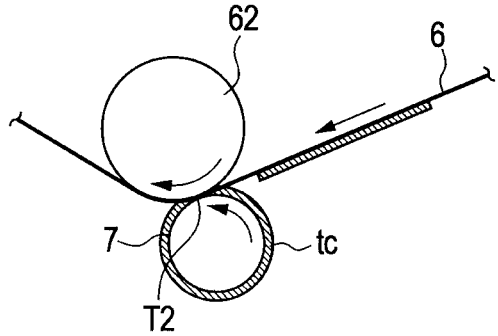
Figure 3C:
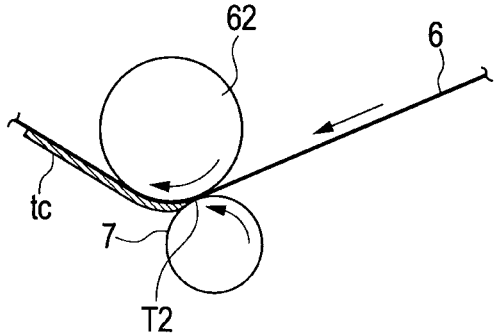

FIGS. 3A to 3C are diagrams schematically illustrating the condition of the image forming apparatus during the cleaning sequence illustrated in FIG. 2B.

FIG. 3A illustrates a condition observed before cleaning assist toner tc formed on the intermediate transfer belt 6 reaches the secondary transfer nip portion T2. In this condition, a cleaning bias of negative polarity has been applied to the second transfer roller 7. FIG. 3B illustrates that the cleaning assist toner tc has been collected on (transferred to) the secondary transfer roller 7. In this condition, the toner has been transferred to the secondary transfer roller 7 so as to cover paper dust having previously adhered to the secondary transfer roller 7. A collecting bias of positive polarity has been applied to the secondary transfer roller 7 in order to collect the toner on the secondary transfer roller 7. FIG. 3C illustrates that a cleaning bias has been applied to the secondary transfer roller 7 and that the cleaning assist toner tc and the paper dust adhering to the cleaning assist toner tc have been transferred to the intermediate transfer belt 6.

Now, image formation using the cleaning assist toner will be described.

Figure 4:
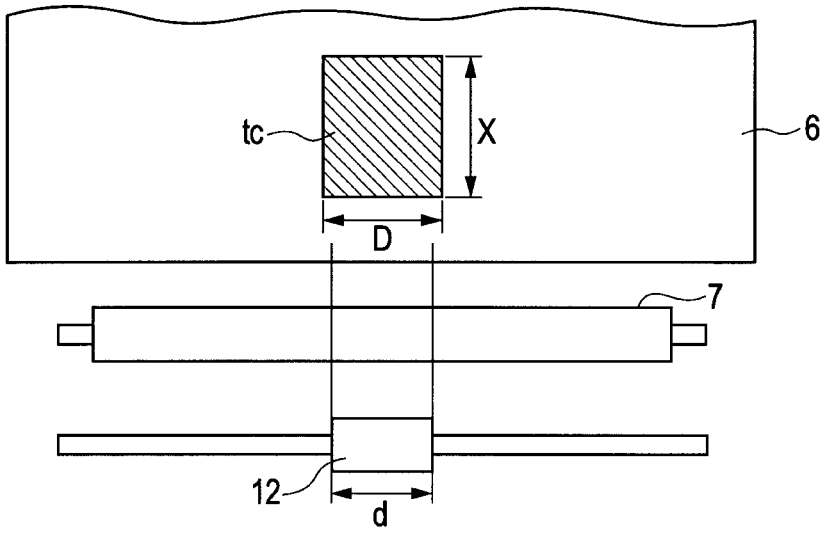
FIG. 4 is a diagram illustrating the positional relationship of components in a direction perpendicular to a conveyance direction of a recording material.

FIG. 4 illustrates the positional relationship among components of the image forming apparatus A in a direction (one of the longitudinal direction and the direction of rotating shaft of the secondary transfer roller 7) perpendicular to the convey direction of the recoding material. Here, the feeding roller 12, serving as a feeding member of the image forming apparatus A according to the present exemplary embodiment, is positioned at the center (longitudinal center) in the longitudinal direction of the image forming apparatus with respect to an image formation position.

The feeding roller 12 slides on and lifts up the recording material with a friction at the center (longitudinal center) in the longitudinal direction thereof to feed the recording material toward the secondary transfer nip portion T2. The feeding roller 12 is formed of a rubber material of length (width) 40 mm in the longitudinal direction. The feeding roller 12 feeds the recording material using the frictional force of the rubber.

The feeding roller 12 rotates while constantly applying pressure to the recording material. Thus, the sliding friction roughens the surface of the recording material, allowing the paper dust to peel off easily. Furthermore, the center of back surface of a recording material pressured by the feeding roller 12 slides on the front surface of a second recoding material placed under the first recording material, with a friction. Thus, paper dust occurs and peels off easily.

Consequently, the following is very likely to be contaminated: an area of the secondary transfer roller 7 which corresponds to a longitudinal position (position in the longitudinal direction) on the feeding roller 12 where a large amount of paper dust having peeled off is present.

As described above, since the feeding roller 12 is often significantly contaminated according to the width thereof, the present exemplary embodiment especially adopts a configuration in which the cleaning assist toner tc is formed according to the width area of the feeding roller 12. That is, the area of the cleaning assist toner tc formed on the intermediate transfer belt 6 during the cleaning mode is set as follows. That is, the area of the cleaning assist toner tc includes a range within which, when the cleaning assist toner image tc is moved to the secondary transfer nip portion T2, a part of the recording material contacted by the feeding roller 12 passes while the recording material is passing by the secondary transfer nip portion T2.

In the present exemplary embodiment, as illustrated in FIG. 4, the cleaning assist toner image tc is formed so as to have margins at the respective opposite ends thereof with respect to the width d of the feeding roller, which is 40 mm; the width D of the cleaning assist toner image tc is 44 mm. Furthermore, in the present exemplary embodiment, a black toner is used as developer.

Additionally, the consumption of toner is higher if the cleaning assist toner tc is formed all over the longitudinal area than if the cleaning assist toner tc is formed in a partial area in the longitudinal direction. Thus, to avoid consuming more toner than necessary, the present exemplary embodiment forms the cleaning assist toner tc sized according to the area of the feeding roller 12, which is significantly contaminated with paper dust.

Furthermore, the length X of the cleaning assist toner tc in the conveyance direction of the recording material may be equal to or larger than one circumference of the secondary transfer roller 7 (circumferential length). In the present exemplary embodiment, the length $X=16\Pi\cong50.3$ mm because the transfer roller adopted has an outer diameter of 16 mm.

The effects of the present exemplary embodiment will be described with reference to Table 1. In the present exemplary embodiment, for more harsh experimental conditions, calcium carbonate paper contaminated with a relatively large amount of paper dust was left in a low-temperature low-humidity environment (temperature was 15° C. and humidity was 10%). Moreover, endurance tests based on continuous printing were conducted also in the low-temperature low-humidity environment.

Table 1 shows a comparison between the effects of the cleaning scheme according to the present exemplary embodiment and the effects of a comparative example.

Table 1 further shows a comparison of the effects of the cleaning mode of the present exemplary embodiment according to the frequency at which the cleaning mode is carried out. Also for image evaluations, dry paper was left in a low-temperature low-humidity environment for a long time in order to set more harsh experimental conditions. Specifically, 216 g of cardboard left in the above-described environment was used. An image evaluation pattern was subjected to 200% printing in a secondary color, and whether or not a transfer failure occurred was checked for comparison.

TABLE 1

| Cleaning | Paper dust contamination condition | Image evaluation results | 100K sheets | 150K sheets | 200K sheets | 250K sheets |
|---|---|---|---|---|---|---|
| REF (conventional cleaning only) | Much paper dust adhering | Transfer failure occurred | OK | NG | NG | NG |
| Cleaning according to present exemplary embodiment performed at every completion of image formation | No paper dust adhering | No transfer failure | OK | OK | OK | OK |
| Cleaning according to present exemplary embodiment performed every 100 sheets | Little paper dust adhering | No transfer failure | OK | OK | OK | OK |
| Cleaning according to present exemplary embodiment performed every 1K sheets | Little paper dust adhering | No transfer failure occurred in former half of durability test and insignificant transfer failure occurred after about 200K sheets | OK | OK | OK | NG |
| Cleaning according to present exemplary embodiment performed every 10K sheets | Adhering | No transfer failure occurred in former half of durability test and insignificant transfer failure occurred after about 150K sheets | OK | OK | NG | NG |

The results indicate that, in the cleaning scheme according to the comparative example, the transfer roller suffered the adhesion of a large amount of paper dust to the transfer roller and thus contamination with the paper dust and that inappropriate image formation resulting from a transfer failure was observed when the number of images formed reached 150K (=150,000; 1,000 sheets are hereinafter represented as 1K sheets). In particular, inappropriate images with excessively low densities started to be formed according to the area of the feeding roller 12.

Now, the case where the cleaning mode according to the present exemplary embodiment was carried out will be described. The effects of the cleaning mode according to the present exemplary embodiment carried out every 100 sheets, every 1K sheets, and every 10K sheets will be described.

First, when the cleaning mode according to the present exemplary embodiment was carried out every 100 sheets, the secondary transfer roller 7 suffered almost no paper dust adhesion or contamination. Inappropriate image formation resulting from a transfer failure was not particularly observed until the number of images formed reached 250K.

When the cleaning mode according to the present exemplary embodiment was carried out every 1K sheets, the secondary transfer roller 7 suffered only insignificant paper dust adhesion and contamination. However, no transfer failure occurred, and the image formation was appropriate and was at a level such that only an insignificant transfer failure was observed when the number of images formed reached about 250K.

Similar results were obtained when the cleaning mode according to the present exemplary embodiment was carried out every 10K sheets. For the paper dust adhesion and contamination of the secondary transfer roller 7, the amount of adhering paper dust was determined to be slightly larger than when the cleaning mode according to the present exemplary embodiment was carried out every 1K sheets. However, no transfer failure occurred, and the image formation was generally appropriate and was at a level such that only an insignificant transfer failure was observed when the number of images formed reached about 200K.

Furthermore, a case will be described where the cleaning mode according to the present embodiment was carried out at any timing, in this case, at a timing when an inappropriate image started to be formed while only the cleaning scheme according to the conventional example was being carried out. Even in this case, the level of the image formation was improved after the cleaning mode according to the present exemplary embodiment was carried out. The cleaning effect on the roller with paper dust adhering thereto was confirmed.

Thus, when the cleaning mode according to the present exemplary embodiment is carried out periodically or at any timing before paper dust accumulates on the secondary transfer roller 7, the secondary transfer roller 7 can always be kept in an appropriate condition in which the secondary transfer roller 7 avoids suffering paper dust adhesion and contamination. This enables appropriate images to be formed.

In the present embodiment, the cleaning assist toner is transferred to and held on an area of the secondary transfer roller 7 to which paper dust has adhered. Then, the toner and the paper dust are allowed to adhere electrostatically and physically to each other. Thereafter, the cleaning transfer bias is applied to the secondary transfer roller 7 to clean the toner image and the paper dust at the same time.

Thus, the toner image and the paper dust can be simultaneously and efficiently cleaned, preventing inappropriate images from resulting from one of the adhesion and accumulation of paper dust. Furthermore, the adoption of the cleaning scheme according to the present embodiment produces a higher cleaning effect on paper dust adhering to the secondary transfer roller 7 than the adoption of the conventional cleaning scheme. This enables prevention of possible accumulation of paper dust and inappropriate image formation resulting from the accumulation of paper dust.

In the description of the present exemplary embodiment, the color image forming apparatus forms a toner image formed of amounts of toner, on the intermediate transfer belt 6. However, the present invention is not limited to this configuration, and is suitably applicable to a monochrome image forming apparatus. That is, a cleaning scheme may be adopted in which, in order to prevent the transfer roller from suffering paper dust adhesion and contamination, a cleaning assist toner image is formed on the photosensitive drum, serving as a image bearing member, and transferred directly to the transfer roller, which is then subjected to a cleaning transfer bias. Also in this case, effects similar to those described above are obtained.

Figure 5:
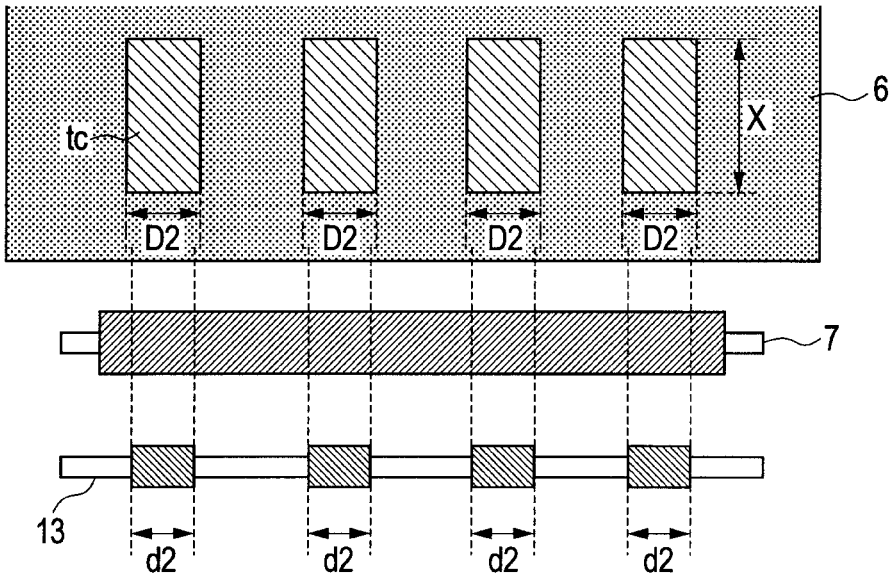
FIG. 5 illustrates the positional relationship between the conveying roller and the cleaning assist toner.

In FIG. 5, the cleaning assist toner tc is formed at according to the position of the feeding roller 12, to which a large amount of paper dust adheres. However, the present invention is not limited to this configuration.

That is, the cleaning assist toner image tc may be formed according to a longitudinal position of the conveying member to which paper dust may adhere. The conveying member as used herein refers to a member configured to convey a recording material fed by the feeding member. In FIG. 1, the conveying member corresponds to the conveying roller 13 and a pre-transfer guide 15.

FIG. 5 to FIG. 9 illustrate positional relationships observed when a toner different from the cleaning assist toner tc in FIG. 4 is formed.

FIG. 5 illustrates the positional relationship between the conveying roller 13, serving as a conveying member, and the cleaning assist toner tc. The conveying roller 13 illustrated in FIG. 1 includes a plurality of rollers distributed as illustrated in FIG. 5. The conveying rollers in FIG. 5 rotate in contact with the conveyed recording material.

The conveying roller 13 in FIG. 5 conveys the recording material S carried from the feeding roller 12, to the secondary transfer nip portion T2 in a sandwiching manner. The conveying roller 13 used herein includes a metal core and a rubber member formed around the metal core.

In the description below, four rubber rollers each with a width d2 of 20 mm are arranged in the longitudinal direction. However, the present invention is not limited to the shape, configuration, and material of these rollers. In this case, since the rubber portion conveys the recording material S in a sandwiching manner, the plurality of rubber rollers slides on the recording maternal with a friction. When an endurance test was conducted on this configuration, the adhesion and accumulation of paper dust on the secondary transfer roller 7 portion, corresponding to the rubber roller, was observed. Thus, in this case, the cleaning assist toner tc is formed to have a width D2 so as to cover the width d2 of the rubber portion. Furthermore, the width D2 was set to 24 mm so as to reliably cover the width d2 of the rubber portion. Thus, as is the case with the above-described effects, if paper dust occurs in the conveying roller 13 portion, the secondary transfer roller 7 can be reliably prevented from suffering paper dust adhesion and contamination.

Figure 6:
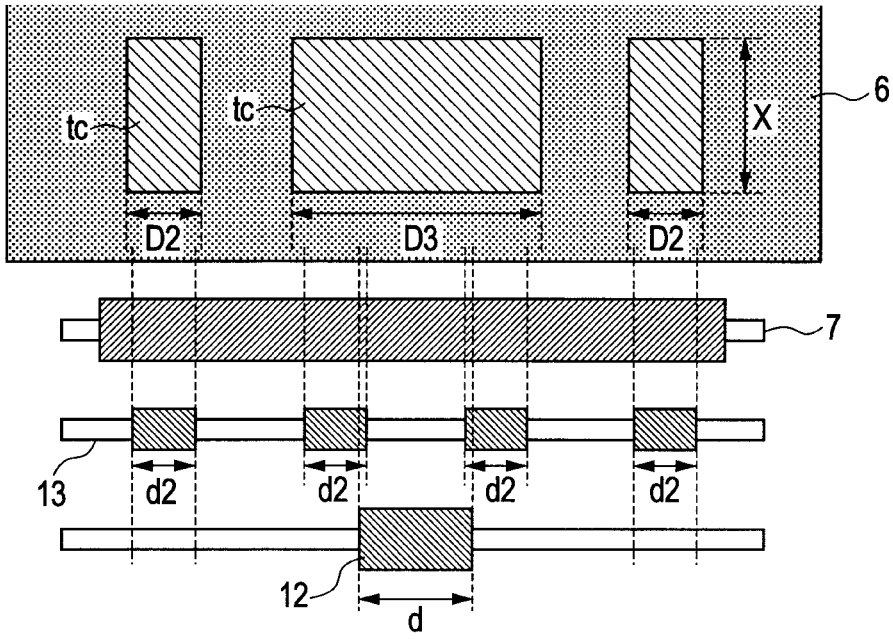
FIG. 6 illustrates the cleaning assist toner formed to cover the entire area where paper dust occurs.

With reference to FIG. 6, a case will be described in which the cleaning assist toner tc is formed so as to cover the entire area where paper dust can occur, including the whole feeding roller 12 and conveying roller 13 described with reference to FIG. 4 and FIG. 5.

As described above, the cleaning assist toner tc is formed so as to span the width D2 according to the width d2 of the rubber rollers of the conveying roller 13 and so as to cover all of the position of the feeding roller and the areas which correspond to the positions of the conveying roller 13 or where the cleaning assist toner tc overlaps the conveying roller 13.

In this case, the cleaning assist toner tc was formed to have a width D3 so as to cover all of the feeding roller width d and the conveying roller width d2. When the cleaning assist toner tc is formed so as to cover all the longitudinal positions where paper dust can occur, the secondary transfer roller 7 can be reliably prevented from suffering paper dust adhesion and contamination all over the longitudinal area thereof.

The configuration has been described in conjunction with the feeding roller 12 and the conveying roller 13. However, the present invention is not limited to this configuration. If any other roller is arranged in the image forming apparatus, the cleaning assist toner tc may be similarly formed in an area of this roller where paper dust is likely to occur.

Figure 7:
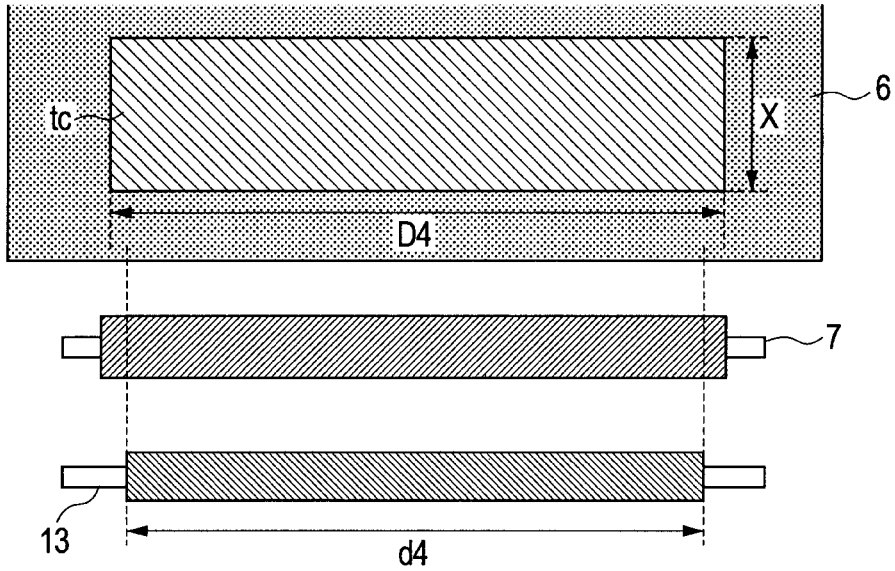
FIG. 7 illustrates the positional relationships around the conveying roller as a through roller extending in a longitudinal direction of the conveying roller.
Figure 8:
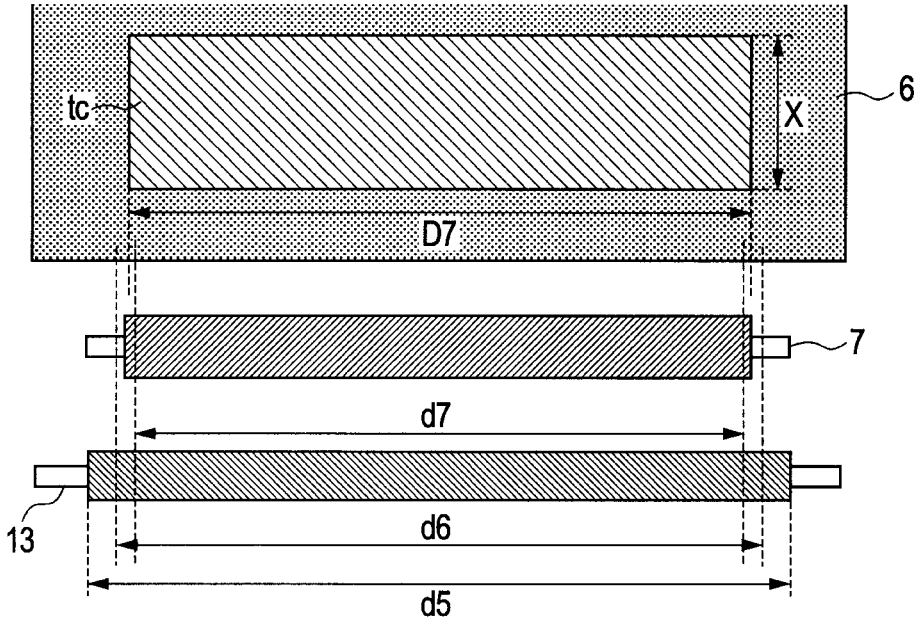
FIG. 8 illustrates the positional relationships around the conveying roller as a through roller extending in a longitudinal direction of the conveying roller.

Furthermore, FIG. 7 and FIG. 8 illustrate that the conveying roller 13 described with reference to FIG. 5 and its related description is a through roller that extends to be longer than that of FIG. 5 in a longitudinal direction of the conveying roller 13. In this case, a singular rubber roller extending in longitudinal direction conveys the recording material S in a sandwiching manner. Thus, the rubber roller slides on the recording material with a friction, and paper dust may adhere to the entire longitudinal area. Therefore, the cleaning assist toner tc is formed to have a width D4 longer than that of the conveying roller 13 according to the longitudinal shape of the through roller.

In FIG. 7, the width d4 of the conveying roller 13 is smaller than that of the secondary transfer roller 7. In this case, the cleaning assist toner tc is formed to have the width D4 equal to the roller width d4 plus a slight margin so as to cover the width d4.

In this case, by way of example, the width of the roller was 200 mm, and the width D4 was 204 mm.

FIG. 8 is a diagram illustrating that the conveying roller 13 has a width d5 larger than that of the secondary transfer roller 7. In this case, an area through which the recording material S actually passes is located inside the width d5 of the conveying roller 13. Thus, the cleaning assist toner tc may be formed at least in one of the area through which the recording material S passes and an area corresponding to a range equal to or larger than the width d7 of an image formation area.

In this case, by way of example, the conveying roller width d5 and the secondary transfer roller width were set to 220 mm and 212 mm, respectively. The maximum sheet feeding width d6 was set to 216 mm, which is equal to the width of a letter-sized sheet. The maximum area d7 in which an image can be formed with blanks taken into account was set to 212 mm. D7 was set to 212 mm according to the area d7.

Figure 9:
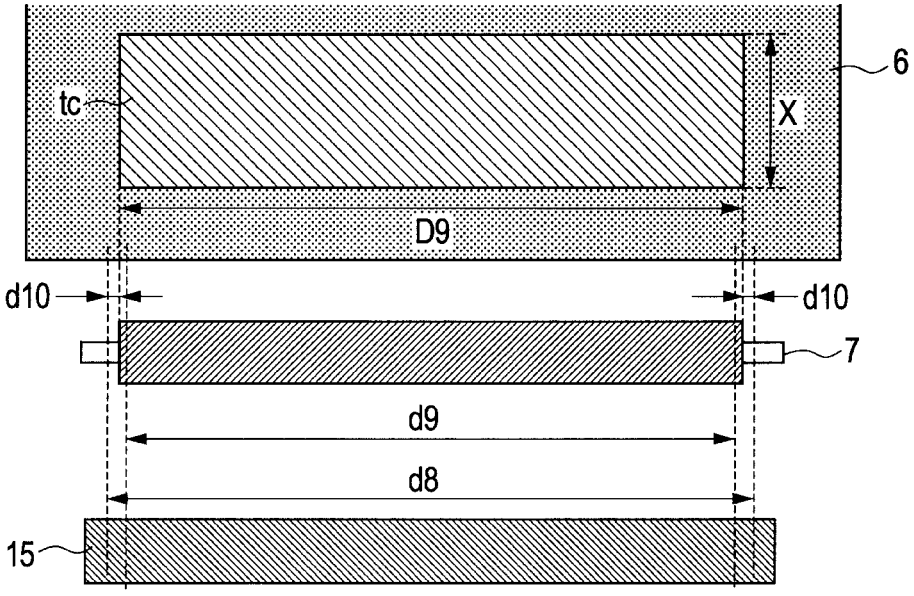
FIG. 9 illustrates the positional relationships around the conveying roller as a through roller extending in a longitudinal direction of the conveying roller.

Furthermore, FIG. 9 illustrates the positional relationship between the pre-transfer guide 15 in FIG. 1 and the cleaning assist toner tc.

The pre-transfer guide 15 needs to stabilize the orientation of the recording material S to smoothly guide the recording material S into the secondary transfer nip portion T2. Hence, the pre-transfer guide often gives a stiffness to the recording material to some degree for conveyance. In this configuration, the stiffness of the recording material S causes the recording material S and the pre-transfer guide 15 to be conveyed while sliding on each other with a friction to some degree. In this case, paper dust may occur in the area where the pre-transfer guide 15 and the recording material S slide on each other with a friction and transfer to the secondary transfer roller 7. Then, the paper dust adheres to the secondary transfer roller 7 all over the longitudinal sheet feeding area. Thus, in such a case, the cleaning assist toner image tc needs to be formed at positions of the pre-transfer guide 15 which correspond to the recording material S and the sliding friction portion.

In the description below, the secondary transfer roller 7 is smaller than a sheet feeding area d8 in width. The longitudinal width of the secondary transfer roller 7 may cover an image formation area with the maximum sheet feeding width. Here, the maximum sheet feeding width d8 is set to 216 mm. The maximum area d9 in which an image can be formed with blanks taken into account is set to 212 mm. The longitudinal width of the secondary transfer roller 7 is set to 212 mm, which is the same as the maximum image formation range d9.

In this case, even if the cleaning assist toner tc is formed to be wider than the sheet feeding area d8 in the longitudinal direction, the cleaning assist toner tc is formed in the entire width of the secondary transfer roller 7 for cleaning, whereby the secondary transfer roller 7 can be reliably prevented all over the longitudinal area thereof from suffering paper dust adhesion and contamination as described above.

On the other hand, in this case, portions (width d10) of the cleaning assist toner tc formed outside the secondary transfer roller 7 remain on the intermediate transfer belt 6 without being transferred to the secondary transfer roller 7. The portions are then collected by the cleaning apparatus 10.

In this case, the width of the cleaning assist toner tc is set equal to the maximum image formable area and equal to or smaller than the width of the secondary transfer roller 7 in order to avoid consuming more toner than necessary and to prevent the cleaning apparatus 10 from being burdened by an unwanted increase in cleaning toner image.

Thus, here, the cleaning assist toner tc is formed at a position according to the maximum image formable area d9 so as to have a width D9. When the cleaning assist toner tc is formed so as to cover all the longitudinal positions where paper dust can occur, the secondary transfer roller 7 can be reliably prevented from suffering paper dust adhesion and contamination all over the longitudinal area thereof.

As described above, regardless of the configurations of the feeding member and the conveying member, the cleaning assist toner tc is formed to cover the longitudinal area in which paper dust can result from the conveyance of the recording material S and attach to the transfer member. The cleaning sequence allows paper dust adhesion and accumulation to be always prevented all over the longitudinal area, enabling appropriate images to be formed.

Exemplary Embodiment 2

Exemplary embodiment 2 will be described below. In the present exemplary embodiment, components different from those of Exemplary Embodiment 1 will be described. Components of the present exemplary embodiment which are similar to those of Exemplary Embodiment 1 will not be described below.

The paper dust cleaning mode described in Exemplary Embodiment 1 includes the step of temporarily transferring cleaning assist toner to the secondary transfer roller 7 and then applying a cleaning transfer bias to the secondary transfer roller 7 for cleaning.

Thus, if toner itself adhering to the secondary transfer roller 7 fails to be sufficiently cleaned, the toner adheres to the back surface of the recording material, and smears occur as a defect.

As described above, regardless of the color of the toner used, the same cleaning effect is produced on paper dust adhesion and contamination on the secondary transfer roller 7. However, visible contamination, that is, smears on a back surface, may occur on the back surface of the recording material depending to the toner color.

Thus, in the present exemplary embodiment, the cleaning assist toner is formed using a yellow toner.

Thus, even if the toner is insufficiently cleaned from the secondary transfer roller 7 and adheres to the back surface of the recording material, possible visible contamination on the back surface of the recording material can be prevented by using a yellow toner as cleaning assist toner.

To prevent possible visible contamination on the back surface of the recording material, the cleaning assist toner image may be formed using toner in a color other than black. However, to further enhance the effect of the prevention, the cleaning assist toner image may be formed by using a yellow toner as in the present exemplary embodiment.

Table 2 shows the results of comparisons of smears on a back surface during image formation following the forced adhesion of a yellow toner to the secondary transfer roller 7. Now, the status of smears on a back surface resulting from execution of the paper dust cleaning mode described in Exemplary Embodiment 1 will be described in a comparative manner.

For comparisons with a large amount of toner forced to adhere to the secondary transfer roller 7, the size of the cleaning assist toner image tc is set as follows. The image width D of the cleaning assist toner image is set equal to the full width in the longitudinal direction (equivalent to an LTR width, that is, 216 mm). The length X in the conveyance direction of the recording material is set to three levels, 100 mm, 200 mm and 300 mm for easy comparison of the effects.

TABLE 2

| Toner | Paper dust contamination condition | Smears on a back surface at L = 100 mm | Smears on a back surface at L = 200 mm | Offseting at L = 300 mm |
|---|---|---|---|---|
| Black toner | No adhesion | OK | NG Insigifinifcant contamiation | NG Insignificant but visible contamination |
| Yellow toner | No adhesion | OK | OK | OK |

The results indicate as follows. If the cleaning assist toner image is formed using a black toner, the possibility of smears on a back surface increases consistently with the amount of toner. However, if the cleaning assist toner image is formed using a toner other than a black toner and more desirably using a yellow toner, visible smears on a back surface do not occur, allowing images to be kept in the appropriate condition.

As described above, when the cleaning assist toner image is formed using a yellow toner as in the present exemplary embodiment, possible smears on a back surface is prevented, enabling the appropriate cleaning condition to be always maintained.

Exemplary Embodiment 3

Exemplary Embodiment 3 will be described. In the present exemplary embodiment, components different from those of Exemplary Embodiment 1 will be described. Components of the present exemplary embodiment which are similar to those of Exemplary Embodiment 1 will not be described below.

The present exemplary embodiment is characterized in that when a cleaning assist toner image is formed, the remaining amounts of a plurality of toners in the respective colors are detected so that one of the toners which has the largest remaining amount is used based on the results of the detection.

For example, if a cleaning assist toner image is formed only of a given color and image formation is frequently carried out, then the toner in that color may disadvantageously be consumed faster than the other toners. Furthermore, if the cleaning mode described in Exemplary Embodiment 1 is carried out with only a small remaining amount of toner, the toner may be exhausted, preventing image formation.

Thus, when a toner consumption condition is detected and a toner to be used is determined depending on the remaining amounts of toners, the consumption only of a toner in a given color is suppressed, and image formation can be always kept enabled.

In the present exemplary embodiment, an optical sensor for detection of toner remaining amount is arranged in each of toner accommodation sections in the development apparatuses 4 (4*a*, 4*b*, 4*c*, and 4*d*) in which toners in yellow, magenta, cyan, and black, respectively, are housed. This enables the remaining amount of toner in the respective development apparatuses to be detected. In the development apparatus 4, a transparent optical window section is provided so that the remaining amount of toner can be detected according to the quality of sensor light transmitted through the optical window section. In the present exemplary embodiment, a toner to be used is determined on the basis of a result of the sensor detection, that is, the cleaning assist toner image is formed using the toner accommodated in one of the plurality of toner accommodation sections which contains the largest remaining amount of toner.

Another advantage of detection of the remaining amount of toner for allowing the use of a toner in a larger remaining amount will be described below.

A toner in a larger remaining amount is relatively new, has a very stable charging amount, and has not substantially been degraded. On the other hand, a toner in a smaller remaining amount has been used for a certain period and is often relatively degraded. Specifically, such a toner has an unstable charging amount. Regularly charged such toners tend to include those having reduced charging amounts, those having increased charging amounts instead, and those having no polarity. Thus, toners in a smaller remaining amount generally vary in charging characteristics and in charging distribution and are thus disadvantageous for image formation.

Thus, when a cleaning assist toner image is formed, the charge of the toner image is more stable during the initial period of toner use, when the toner has a larger remaining amount. After long use, the charge of the toner image is less stable. The efficiency of cleaning is also higher during the initial period of toner use, when the toner is new, than after long use.

Table 3 shows the results of image evaluations for toner consumption following cleaning. In Table 3, the effects of cleaning are compared which were observed when the cleaning mode described in Exemplary Embodiment 1 was carried out, in a low-temperature low-humidity environment, on the secondary transfer roller 7 forcibly contaminated with paper dust by increasing the feeding pressure of the feeding roller 12.

TABLE 3

| Toner condition | Paper dust contamination condition after cleaning | Image evaluation results |
|---|---|---|
| New toner | OK Little paper dust adhering | OK |
| Toner in the middle of long use | OK Little paper dust adhering | OK |
| Toner at the end of long use | NG Paper dust adhering | OK |

The results indicate as follows. When a new toner and a toner in the middle of long use were used, the paper dust contamination level was relatively low, and no image defect was observed. When a toner at the end of long use was used, no significant difference was observed in image evaluation results between this toner and the above-described toners, and no transfer failure occurred. However, a difference was observed in paper dust adhesion condition and in contamination level.

That is, more paper dust adhering was observed when the toner at the end of long use was used than when the new toner and the toner in the middle of long use were used.

As described above, according to the present exemplary embodiment, when a cleaning assist toner image is formed, the remaining amounts of a plurality of toners in the respective colors are each detected so that a relatively new one of the toners which has a larger remaining amount is used. This enables consumption only of a toner in a given color to be avoided. Furthermore, a toner not substantially degraded is used, thus enabling cleaning efficiency to be improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-274700, filed Dec. 9, 2010, which is hereby incorporated by reference herein in its entirety.

What is claimed is:

1. An image forming apparatus, comprising:

an image bearing member that bears a toner image;

an image forming unit that forms a toner image on the image bearing member;

a control unit;

a transfer member that forms a transfer portion with the image bearing member and transfers the toner image from the image bearing member to a recording material conveyed to the transfer portion;

a feeding member that feeds the recording material to the transfer portion; and wherein the control unit is capable of performing a cleaning mode including:

a first step in which the image forming unit forms, on the image bearing member, a cleaning toner image with a length according to a length of the feeding member in a direction perpendicular to a conveyance direction in which a recording material is conveyed;

a second step of moving the cleaning toner image from the image bearing member to the transfer member; and a third step of moving the cleaning toner image from the transfer member to the image bearing member.

2. An image forming apparatus according to claim 1, wherein the length of the cleaning toner image is larger than a length of the feeding member and smaller than a length of the transfer member in the direction perpendicular to the conveyance direction of the recording material.

3. An image forming apparatus according to claim 1, wherein the transfer member is a rotatable transfer roller, and a length of the cleaning toner image in the recording material conveyance direction is equal to or larger than a circumferential length of the transfer roller.

4. An image forming apparatus according to claim 1, wherein, in the third step, a substance adhering onto the transfer member from the recording material conveyed to the transfer portion is moved to the image bearing member together with the cleaning toner image.

5. An image forming apparatus according to claim 1, wherein the cleaning mode comprises a fourth step in which voltages of positive and negative polarities are alternately applied to the transfer member, after the third step.

6. An image forming apparatus according to claim 1,
wherein the image bearing member is an endless intermediate transfer belt,
wherein said image forming apparatus includes a plurality of the image forming units according to a plurality of toners in respective colors including black, and
wherein a toner in a color other than black is used for the cleaning toner image formed by the image forming unit during the cleaning mode.

7. An image forming apparatus according to claim 1,
wherein the image bearing member is an endless belt member,
wherein the image forming unit comprises a toner containing unit that contains a toner, and
wherein the image forming apparatus further comprises a plurality of other image forming units comprising respective toner containing units with corresponding toners in other respective colors, and
in the first step during the cleaning mode, the control unit uses a toner contained in one of the plurality of toner containing units which have a largest remaining amount, for the toner image formed by the image forming unit.

8. An image forming apparatus according to claim 1, wherein the feeding member is a feeding roller configured to slide on and scuff the recording material with a friction, in a center of the feeding member in the direction perpendicular to the conveyance direction of the recording material.

9. An image forming apparatus, comprising:
an image bearing member that bears a toner image;
an image forming unit that forms a toner image on the image bearing member;
a control unit;
a transfer member that forms a transfer portion with the image bearing member and transfers the toner image from the image bearing member to a recording material conveyed to the transfer portion;
a feeding member that feeds the recording material to the transfer portion; and
wherein the control unit is capable of carrying out a cleaning mode including:
a first step in which the image forming unit forms, on the image bearing member, a cleaning toner image with a length according to a length of the feeding member in a direction perpendicular to a direction in which a recording material is conveyed;
a second step of moving the cleaning toner image from the image bearing member to the transfer member; and
a third step of moving the cleaning toner image from the transfer member to the image bearing member.

10. An image forming apparatus according to claim 9, wherein the length of the cleaning toner image is larger than the length of the conveying member and smaller than a length of the transfer member in the direction perpendicular to the conveyance direction of the recording material.

11. An image forming apparatus according to claim 9, wherein the transfer member is a rotatable transfer roller, and the length of the cleaning toner image in the recording material conveyance direction is equal to or larger than a circumferential length of the transfer roller.

12. An image forming apparatus according to claim 9, wherein, in the third step, a substance adhering onto the transfer member from the recording material conveyed to the transfer portion is moved to the image bearing member together with the cleaning toner image.

13. An image forming apparatus according to claim 9, wherein the cleaning mode comprises a fourth step in which voltages of positive and negative polarities are alternately applied to the transfer member, after the third step.

14. An image forming apparatus according to claim 9,
wherein the image bearing member is an endless intermediate transfer belt,
wherein said image forming apparatus includes a plurality of the image forming units according to a plurality of toners in respective colors including black, and
a toner in a color other than black is used for the cleaning toner image formed by the image forming unit during the cleaning mode.

15. An image forming apparatus according to claim 9, wherein the image bearing member is an endless belt member,
the image forming unit comprises a toner containing unit configured to accommodate a toner, and the image forming apparatus further comprises a plurality of other image forming units comprising respective toner containing units with corresponding toners in other respective colors, and
in the first step during the cleaning mode, the control unit uses a toner accommodated in one of the plurality of toner containing units which has a largest remaining amount, for the toner image formed by the image forming unit.

16. An image forming apparatus according to claim 1, wherein the conveying member is a plurality of rubber rollers provided in the direction orthogonal to the conveyance direction of the recording material, and the cleaning toner is a toner image that is longer than each rubber roller in the direction perpendicular to the recording material conveyance direction.

* * * * *